US005353979A

United States Patent [19]

Gartmann

[11] Patent Number: 5,353,979

[45] Date of Patent: Oct. 11, 1994

[54] DIRECTING APPARATUS FOR GUIDING, DEFLECTING AND/OR DIVERTING A WEB OF MATERIAL

[75] Inventor: Uwe Gartmann, Wiesbaden, Fed. Rep. of Germany

[73] Assignee: Hoechst Aktiengesellschaft, Frankfurt am Main, Fed. Rep. of Germany

[21] Appl. No.: 77,504

[22] Filed: Jun. 17, 1993

Related U.S. Application Data

[63] Continuation of Ser. No. 778,274, Oct. 17, 1991, abandoned.

[30] Foreign Application Priority Data

Oct. 23, 1990 [DE] Fed. Rep. of Germany ..... 4033642

[51] Int. Cl.[5] ..... B65H 23/00

[52] U.S. Cl. ..... 226/196; 226/97

[58] Field of Search ..... 226/7, 97, 196, 197, 226/199, 15, 22; 34/156, 160

[56] References Cited

U.S. PATENT DOCUMENTS

| | | | |
|---|---|---|---|
| 3,125,268 | 3/1964 | Bartholomay | 226/197 X |
| 3,521,802 | 7/1970 | Bossons | 226/97 |
| 3,971,496 | 7/1976 | Karsh | 226/15 X |
| 4,037,767 | 7/1977 | Karsh et al. | 226/197 X |
| 4,138,047 | 2/1979 | Sherman | 226/97 X |
| 4,751,602 | 6/1988 | Beaujean | 226/196 X |
| 5,152,080 | 10/1992 | Wimberger | 226/15 X |

FOREIGN PATENT DOCUMENTS

| | | | |
|---|---|---|---|
| 0001323 | 4/1979 | European Pat. Off. . | |
| 3904314 | 8/1990 | Fed. Rep. of Germany . | |
| 4003956 | 8/1990 | Fed. Rep. of Germany . | |
| 285760 | 1/1991 | Fed. Rep. of Germany | 226/97 |
| 1385098 | 11/1984 | France . | |
| 905302 | 9/1962 | United Kingdom . | |

*Primary Examiner*—Daniel P. Stodola
*Assistant Examiner*—Eileen A. Dunn
*Attorney, Agent, or Firm*—Foley & Lardner

[57] ABSTRACT

A directing apparatus for guiding, deflecting and/or diverting a web of material including a block which has a curved surface. The block is segmented, i.e. divided into sections, and in each section there is a certain number of bores, to which streams of medium are admitted at various velocities or with various quantities of medium. In each of the sections, a predetermined number of bores are connected to one another and are connected via a common line to a common medium supply device. The medium may be either compressed air or a liquid.

19 Claims, 3 Drawing Sheets

DIRECTING APPARATUS FOR GUIDING, DEFLECTING AND/OR DIVERTING A WEB OF MATERIAL

This application is a continuation of application Ser. No. 07/778,274, filed Oct. 17, 1991 and now abandoned.

BACKGROUND OF THE INVENTION

The invention relates to a directing apparatus for guiding, deflecting and/or diverting a web of material which is guided over a number of rollers, said apparatus being connected to a medium supply device. More particularly, the invention relates to such an apparatus in which the directing apparatus extends over the entire width of the rollers and has bores, through which a stream of medium flows against the web of material in a direction which is predetermined in each case.

German Offenlegungsschrift 3,904,314 discloses such an air directing apparatus for guiding an endless web of material, for example a web of paper, which runs in a meandering manner over a plurality of cylinders or alternately over cylinders and directing rollers. This air directing apparatus is connected to a blown air supply and extends transversely over the entire width of the cylinder and directing rollers, air being blown against the web of material via blow openings extending in the predetermined direction. The blowing direction of the air is reversible, with the reversal taking place by two successive pressure chambers which are separate from each other and of which one acts in normal operation as a suction chamber and the downstream one acts as a blowing chamber. These chambers are switchable in such a way that the pressure chamber on the feed side is made to act as a blowing chamber and the downstream pressure chamber is made to act as a suction chamber. The air directing apparatus can also be divided transversely to the running direction of the web of material into a number of separate air chambers. In this case, a chamber at the edge is provided for transferring a transfer strip during starting or after a tearing-off of material. Each air chamber can be set individually with respect to the blowing direction, according to the predetermined blowing direction or the direction inverted or perpendicular thereto. Similarly, the quantities of air can be set according to the blowing direction.

By the known air directing apparatus, on the one hand, the endless web of material is guided reliably on its path to and between the cylinders and/or the directing rollers. On the other hand, the known apparatus maximizes the conditioning of the web of material, for example its drying.

In the normal operation of a paper machine, the web of paper runs from cylinder to cylinder. The air directing apparatus counteracts the forces acting on the web due to adhesion, friction, vacuum, dynamic pressure, the weight of the web, and centrifugal forces. In this case it must be taken into consideration that with such air directing apparatuses, it also intended to achieve an optimum drying effect. An optimum drying effect is achieved if air is blown out against the running direction of the web of paper, since this has the effect of producing turbulence on the surface of the web of paper, which accelerates the drying. However, during starting of a paper machine or after a tearing-off of the web of paper during threading of the so-called transfer strip, such a blowing direction against the running direction of the web of paper is unfavorable, since the relatively narrow transfer strip is blown away by the blow jet on account of its relatively small weight. In the case of the known air directing apparatus, an individual adaptation of the direction and conditions of the blown air to the respective operating state and the respective type of material is possible by virtue of the fact that the blowing direction can be inverted and, what is more, the web of paper can be subjected to the blowing of air in different sections, considered in the running direction.

German Offenlegungsschrift 4,003,956 discloses a vacuum nozzle system for the contactless supporting and treating of webs of material, for example for drying, heating and cooling. This vacuum system comprises a nozzle casing which has a surface which lies against the web and on which there are two nozzle gaps. The nozzle system is asymmetrical in relation to the perpendicular center plane of the vacuum supporting surface. The nozzle casing has a substantially planar supporting surface, at the one edge of which an arcuate Coanda air directing surface is attached, at which the first nozzle of the nozzle system is located. The blowing direction of this nozzle initially runs substantially perpendicularly against the plane of the web of material to be supported. The Coanda air directing surface is arranged in such a way that it diverts the air flow emerging from the first nozzle in the direction of the plane of the supporting surface and the web of material running over the latter. In the edge region opposite the first nozzle there is a directing baffle which smoothly continues the planar supporting surface. A second blowing nozzle is arranged in the region of or at the outer edge of the directing surface. The direction of the second nozzle runs parallel to the directing surface of the supporting surface.

An apparatus for monitoring the edge of the web of a guided web of material is described in German Offenlegungsschrift 3,903,783. This concerns an apparatus for conveying a flat article, in particular an endless web of material. The apparatus comprises conveying means for moving the article in a predetermined direction and a monitoring device for monitoring the position of the article. The monitoring device includes a blowing nozzle which is directed at the edge region of the surface of the article and blows out a jet of gas. On the side of the article opposite the blowing nozzle there is provided a pressure measuring device for generating a measuring signal corresponding to the proportion of the gas jet flowing past the edge. The pressure measuring device is connected to an evaluating and controlling arrangement for processing the measuring signals into position signals, which reproduce the position of the edge of the article. Such an apparatus permits an exact processing and working of articles since a web of material such as paper or some other flat article can be conveyed along a predetermined path while preventing lateral positional deviations. This is performed by the continuous monitoring of the position of an edge of the above material or of the flat article and by corrective measures being initiated if deviations from a predetermined position of the edge occur. By this side-edge control, consequently, a lateral shifting of the article is prevented.

Side-edge controls are also known in which the unwinding reel for the web of material is displaced axially or the angle of a directing roller perpendicular to a web plane is altered. Both versions require greater mechanical complexity and are limited in their dynamic characteristics.

OBJECTS AND SUMMARY OF THE INVENTION

The object of the invention is to improve a directing apparatus of the type described above which operates in such a way that, when deflecting and/or diverting the web of material, during which the curvature of the web of material can change in dependence on the web width, the side edges of the web of material are guided without lateral deviation.

In accordance with a first aspect of the invention, a directing apparatus is provided for guiding, deflecting, and diverting a web of material which is guided over a number of rollers. The directing apparatus comprises a block which is connectable to a medium supply device. The block extends over the entire width of the rollers and has a curved surface over which the web can be led. The curved surface has bores formed therein which extend transversely to the web and through which medium can flow out of and against the web from the medium supply device in designated directions at variable velocities and variable volumes.

Advantageously, bores are provided in separate sections which are connected to one another, and the block has sections formed in a portion of the curved surface which faces the web. The sections have rear sides which are spaced a designated distance from the portion of the curved surface. The bores include restriction bores which are formed in the sections. Lines extend through the block and are adapted to connect the sections to the medium supply device, and control valves are located in the lines outside of the block and control the flow of medium into the respective lines.

In accordance with another aspect of the invention, the block has sections formed in a portion of the curved surface which faces the web, and the bores include restriction bores which are formed in the sections. In addition, a central bore is formed in a central portion of the block, and radial channels are formed in the block and connect the restriction bores to the central bore.

In accordance with yet another aspect of the invention, a system is provided which comprises a plurality of rollers and a directing system for guiding, deflecting, and diverting a web of material over the rollers. The directing system includes a directing apparatus and a medium supply device for supplying a medium to the directing apparatus. The directing apparatus comprises a block which is connected to the medium supply device. The block extends over the entire width of the rollers and has a curved surface over which the web is led. The curved surface has bores formed therein which extend transversely to the web and through which medium flows out of and against the web from the medium supply device in designated directions at variable velocities and variable volumes.

Another object of the invention is to provide a method of guiding, deflecting, and diverting a web of material which is guided over a number of rollers.

In accordance with one aspect of the invention, the method comprises leading the web over a curved surface of a block which extends over the entire width of the rollers, and drawing a medium out of a medium supply device. Another step includes feeding the medium into the block, through bores which are formed in the curved surface of the block and which extend transversely to a surface of the web, and against the surface of the web at variable velocities and at variable volumes.

In accordance with another aspect of the invention, further steps include feeding the medium through lines which extend through the block and which connect the sections to the medium supply device, and controlling the flow of medium into the respective lines via selectively operating control valves which are located in the lines outside of the block.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention is explained in further detail below with reference to exemplary embodiments represented in the drawings, in which.

DETAILED DESCRIPTION OF THE PREFERRED EMBODIMENTS

The objects are achieved according to the invention by providing bores which extend, transversely to the web of material, in a curved block over which the web of material is led. Streams of medium can be admitted to the bores at various velocities or with various quantities of medium.

Thus, in an exemplary embodiment of the invention, the block is cylindrical, the bores are provided in sections and in each case a predetermined number of bores in the sections are connected to one another. In this case, the bores are arranged as restriction bores in a surface facing the web of material. This surface is located at a predetermined distance from rear sides of the sections of the block.

The different actuation of the individual sections of the segmented block, which is a type of supporting nozzle, produces lateral force components alongside the longitudinal edges of the web of material which are used for side-edge guidance.

The invention can be used both in the case of webs of material disposed in air and in the case of webs of material which are transported in baths filled with liquids. The first case may concern the transporting of thin films or foils or metal webs in dryer apparatuses, whereas the second case may involve the guidance of aluminum webs in electroplating baths.

Figure 1:
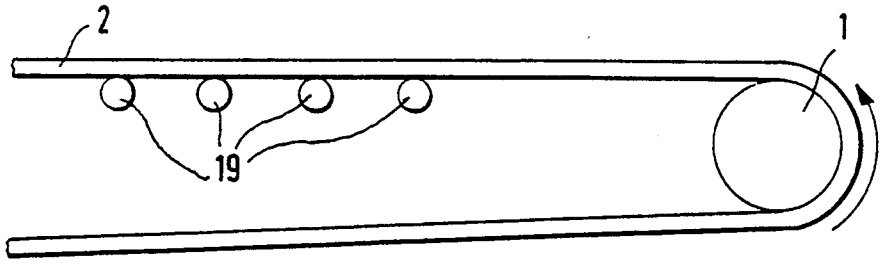
FIG. 1 shows a diagrammatic representation of a web of material which is guided over a number of rollers and an air directing apparatus.

FIG. 1 diagrammatically shows a web of material 2, for example an aluminum web, a web of paper, a web of film, or foil or the like. The web 2 is guided over rollers 19 and a directing apparatus 1. The directing apparatus 1 comprises as an essential component a segmented, i.e. divided into sections, supporting nozzle in the form of a block having a curved surface, in which bores are arranged within the individual sections. Compressed air is admitted to the supporting nozzle via a supply device and the nozzle provides a trouble-free diverting and/or deflecting and an exact side-edge guidance of the web of material 2. In this case, diverting should be understood to mean a deviation from the original plane of movement. Deflecting is to be understood as a deviation from the original direction of movement in the same plane of movement.

Figure 2:
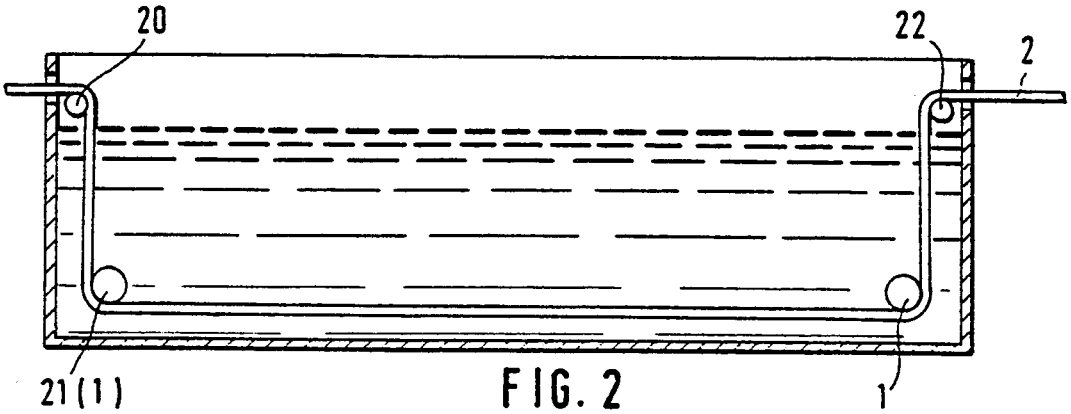
FIG. 2 shows a diagrammatic representation of a web of material which runs through a liquid bath and is guided around one or more hydraulic directing apparatuses.
Figure 3:
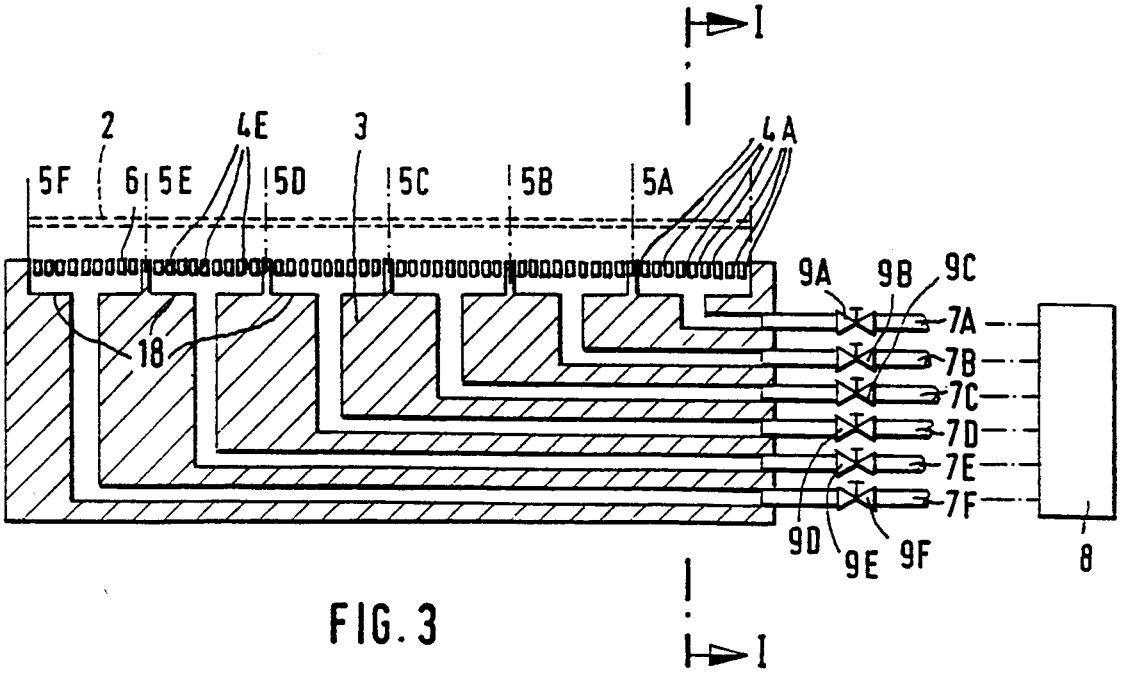
FIG. 3 shows a section through a diagrammatically represented first embodiment of the directing apparatus with a circular cross-section of the supporting nozzle, according to the invention.

FIG. 2 shows in diagrammatic overview the transporting of a web of material 2 through a liquid bath, for example the running of an aluminum web through an electroplating bath. The web of material 2 is introduced via diverting rollers 20, 21, a directing apparatus 1 and a further diverting roller 22 into the liquid bath. The web is then transported through the bath and is led out from it. In this case, it is expedient if the bath liquid of the liquid bath is used as the operating medium for the directing apparatus 1. The directing apparatus 1 facilitates the diverting of the web of material 2, since the latter is lifted off the surface by the medium flowing out from the bores in the surface of the supporting nozzle of the directing apparatus 1, so that neither adhesive forces nor frictional forces have to be overcome during the directional diversion. Instead of the one diverting roller 21, a further directing apparatus 1 may be provided, FIG. 3 diagrammatically shows a first embodiment of a directing apparatus 1 according to the invention. The directing apparatus 1 comprises, inter alia, a supporting nozzle in the form of a block 3 having a curved surface, which has a circular cross-section, as can be seen from FIG. 4. At a small distance from the curved surface, a web of material 2 is guided over the supporting nozzle. Bores 4A to 4F run in the block 3 transversely to the web of material and are provided in sections 5A, 5B, . . . 5F of the block 3. These sections form fluid or medium bearings for the web. A predetermined number of bores, which are provided in each of the individual sections, are connected to one another and are connected to a medium supply device via a common line 7A, 7B, . . . 7F. The bores 4A to 4F are designed as restriction bores and are arranged in a surface 6 facing the web of material 2. This surface 6 is at a certain distance from rear sides 18 of the sections 5A, . . . 5F of the block 3. As already mentioned above, each of the sections 5A, . . . 5F is connected to the medium supply device 8 via a line 7A, . . . 7F, which lines are led through the block 3. In each of the lines 7A, . . . 7F, outside the block 3, there is a control valve 9A, . . . 9F, by means of which the respective stream of medium through the lines to the bores of the individual section can be controlled. After flowing through the restriction bores of the individual sections, the streams of medium flow against the direction of movement of the web of material in a direction which is predetermined in each case. The flow through the lines is controlled by means of the control valves 9*a*, . . . 9F such that the streams of medium have, for example, various velocities in the individual sections, or such that varying quantities of medium are applied to the individual sections. The web of material 2 is diverted over the cylindrical block 3. In the region of the curvature, the various restriction bores are located in the individual sections, in FIG. 4 only the restriction bores of section 5A are shown, by way of example. Compressed air or a liquid may be used as the medium. If the restriction bores in the individual sections are supplied with compressed air, a film of supporting air is produced between the block 3 and the web of material 2. The gaps ahead of and behind the bores as well as to the sides of the bores form restriction zones, so that a pressure build-up takes place between the web of material 2 and the block 3. If pressure is applied differently to the individual sections, the distance of these gaps from the surface of the block can be varied locally. In other words, the web of material is guided at various radii above the individual sections and consequently the web of material can, in a desired way, not only be diverted but also deflected, as will be explained in still further detail below. This results in a deflection of the web of material dependent on the inclined position of the web of material with respect to the surface of the block 3. By the selective application of compressed air to the sections 5A, . . . 5F, a controlled deflection or lateral guidance of the web of material can be achieved, as will be explained in further detail later with reference to FIG. 5.

Figure 4:
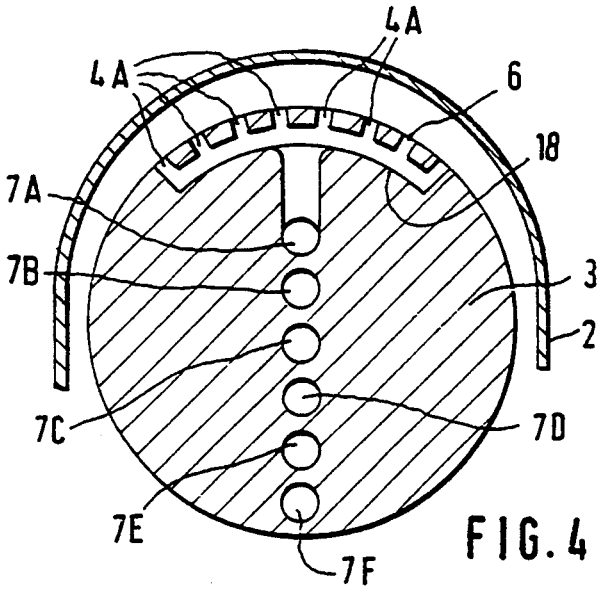
FIG. 4 shows a section through a section 5A of the supporting nozzle along the line I—I in FIG. 3.

FIG. 4 shows a section through the section 5A of the block 3 or the supporting nozzle along the line I—I in FIG. 3. The central bore of this sectional representation shows the cross-section of the line 7A, from which a channel leads upward and opens out into the section 5A. The restriction bores 4A are formed in the manner of a grid and ensure that a pressure build-up takes place in the section 5A and the medium, for example air, leaves the restriction bores 4A and flows against the web of material with appropriate pressure.

Figure 5:
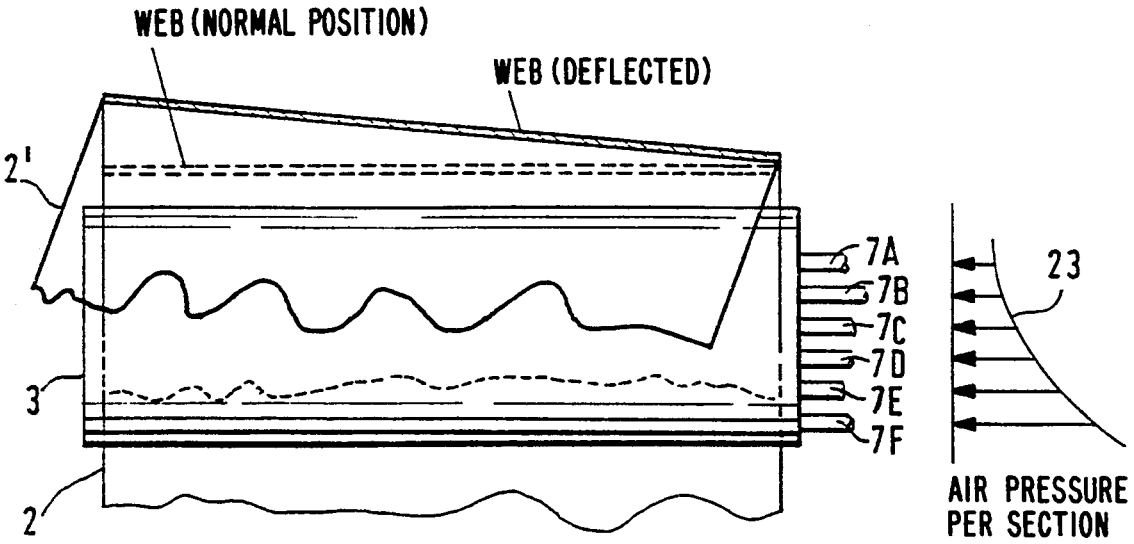
FIG. 5 shows a diagrammatic view of the deflecting of a web of material by means of a directing apparatus according to FIGS. 3 and 4, FIG. 6 Shows a section through a section A of a second embodiment of the directing apparatus with an elliptical cross-section of the supporting nozzle

FIG. 5 diagrammatically shows the deflecting of the web of material 2, which in the normal case is led around the block 3 at a uniform distance. If the air pressure in each of the sections 5A to 5F of the first embodiment of the directing apparatus 1 is increased according to the air pressure curve 23, the air pressure prevailing in the line 7A and in the section 5A is at its lowest and the air pressure prevailing in the line 7F and in the section 5F is at its highest. As a result of this pressure distribution, the web of material 2 at the right-hand end of the block 3 assumes the smallest distance and at the left-hand end of the block 3 the greatest distance from the surface of the block and, as a result, is deflected out of its normal orbital path and assumes the position shown as deflected web of material 2'.

Figure 6:
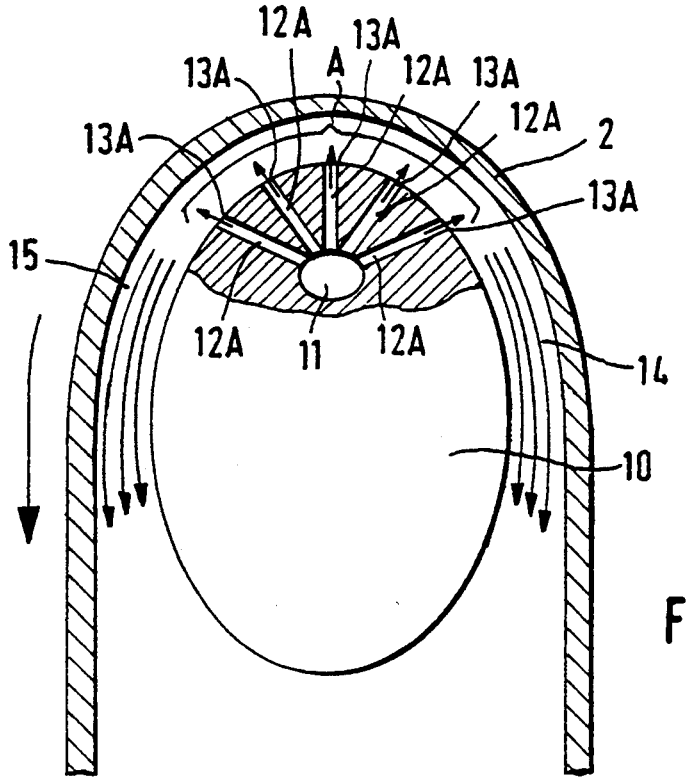

FIG. 6 shows a section through a section A of a second embodiment of the directing apparatus. The block or the supporting nozzle is designed as a diverting block 10 with an elliptical cross-section. Inside the elliptical diverting block 10 there is a central bore 11, from which radial channels 12A lead to restriction bores 13A in the surface of the diverting block 10. The cross-sectional area of the central bore 11 is considerably greater than the cross-section of the radial channels 12A. As a result, a corresponding restriction of the medium flow occurs and, consequently, a pressure increase of the medium which passes through the restriction bores 13A of the section A of the elliptical diverting block 10 occurs. The diverting block 10 of the second embodiment of the directing apparatus serves, just like the block 3 of the first embodiment of the directing apparatus, primarily for a diversion of the web of material 2 through 180°. In longitudinal section, the diverting block 10 resembles the block 3 of the first embodiment according to FIG. 3, i.e. the diverting block 10 is divided into various sections A to E, and each section is assigned a number of restriction bores 13A to 13E. In FIG. 6, only the central bore 11 as well as the radial channels 12A and the restriction bores 13A of the section A are shown in cross-section. The other sections with 10 their channels and with their central bore are constructed in the same way.

As can be seen from FIG. 6, gaps 14 and 15 are provided ahead of and behind the restriction bores 13A, seen in the running direction of the web of material 2. To the sides of the restriction bores 13A there are likewise gaps, which, together with the gaps 14 and 15, form restriction points for the medium flowing out, so that a pressure build-up takes place between the diverting block 10 and the web of material 2. This pressure build-up ensures that the web of material 2 is led around the surface of the deflecting block 10 at a distance. The film of supporting medium formed between the diverting block 10 and the web of material 2 has a thickness which varies according to the respective pressure of the medium in the individual channels 12A, . . . 12E of the sections A to E of the diverting block 10.

Figure 7:
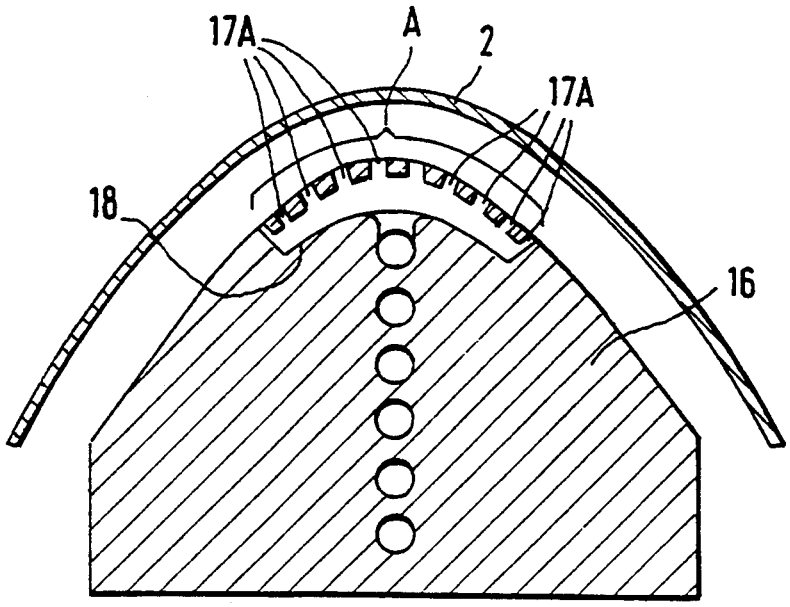
FIG. 7 shows a cross-section through a section A of a third embodiment of a directing apparatus, having a supporting nozzle of a parabolic cross-section.

In a third embodiment of the directing apparatus, as is shown in FIG. 7, the diverting block 16 has a parabolic cross-section. This embodiment of the directing apparatus is suitable in particular for a diversion of the web of material of less than 180°. The diverting block 16 is likewise divided into sections A to E, in which restriction bores 17A, . . . 17E are arranged in each case.

In the case of all three embodiments of the directing apparatus, the medium for guiding and diverting the web of material 2 may be either compressed air or any other compressed gas or the respective bath liquid if the web of material 2 is led through a liquid bath, for example an electroplating bath.

What is claimed is:

1. A directing apparatus for guiding, transversely deflecting, and diverting a web of material which is guided over a number of rollers, said directing apparatus comprising:

a block which is connected to a medium supply device for supplying a medium, said block having a curved surface over which said web can be led, said curved surface having a plurality of bores provided in each of separate sections and which extend transversely to said web, a plurality of said separate sections being provided for said web of material and forming fluid bearings for said web; lines which extend through said block and connect said separate sections to said medium supply device whereby through said lines said medium can flow out of said bores and against said web from said medium supply device; and control valves, located in said lines outside of said block, for controlling the flow of said medium into the respective lines at variable velocities and variable volumes to supply a different fluid pressure to each separate section to create a pressure gradient across the web's width to deflect and divert said web from a first guided direction of travel to a second guided direction of travel depending on said pressure gradient which urges said web from the surface of the block.

2. The directing apparatus as claimed in claim 1, wherein said block is cylindrical in shape and the bores in each of said separate sections are connected to one another.

3. The directing apparatus as claimed in claim 2, wherein said block has said separate sections formed in a portion of said curved surface which faces said web, each of said separate sections having rear sides which are spaced a designated distance from said portion of said curved surface, and said bores include restriction bores which are formed in said separate sections.

4. The directing apparatus as claimed in claim 1, wherein said block comprises a diverting block having an elliptical cross-section.

5. The directing apparatus as claimed in claim 4, wherein said block as said separate sections formed in a portion of said curved surface which faces said web, said bores include restriction bores which are formed in said separate sections, a central bore is formed in a central portion of said block, and radial channels are formed in said block and connect said restriction bores to said central bore.

6. The directing apparatus as claimed in claim 5, wherein gaps are formed ahead, behind, and beside said restriction bores to produce restriction points.

7. The directing apparatus as claimed in claim 1, wherein said block comprises a diverting block for the diversion of said web through an angle of less than 180°, and wherein said block has a parabolic cross-section, and restriction bores are located on the surface of said block.

8. A method of guiding, transversely deflecting, and diverting a web of material which is guided over a number of rollers, said method comprising:

providing a block having a curved surface over which said web is led, said curved surface having a plurality of bores provided in each of separate sections and which extend transversely to said web, a plurality of said separate sections being provided for said web of material and forming fluid bearings for said web;

leading said web over the curved surface of the block;

drawing a medium out of a medium supply device; and feeding said medium through each of said plurality of said separate sections and against a surface of said web at variable velocities and at variable volumes to impinge on said web with a pressure gradient across the web's width such that said pressure gradient deflects and diverts said web from a first direction of travel, which is maintained when the medium is fed at constant velocities and constant volumes to each of said separate sections, to a second direction of travel.

9. The method as claimed in claim 8, wherein said step of feeding said medium through said separate sections comprises the step of feeding said medium through restriction bores which are formed in each of said separate sections that are formed in a portion of said curved surface of said block which faces said web.

10. The method as claimed in claim 8, wherein the step of feeding said medium includes the step of feeding said medium through lines which extend through said block and which connect said separate sections to said medium supply device, and wherein the method further comprises the step of controlling a flow of medium into respective lines by selectively operating control valves which are located in said respective lines outside of said block.

11. The method as claimed in claim 8, wherein said step of feeding said medium through said separate sections comprises the step of feeding said medium through restriction bores, and further comprising the step of feeding said medium through restriction points formed by gaps formed ahead, behind, and beside said restriction bores, thereby building up pressure between said block and said web.

12. The method as claimed in claim 8, wherein said step of feeding said medium comprises the step of feeding said medium through radial channels formed in said block, said method further comprising the steps of forming a supporting film of said medium between said block and said web and varying pressures of said medium in said radial channels to vary a thickness of said film.

13. The method as claimed in claim 8, wherein said steps of drawing and feeding said medium comprises the steps of drawing and feeding compressed air.

14. The method as claimed in claim 8, wherein said step of leading said web comprises the step of leading said web through a liquid bath, and wherein said steps of drawing and feeding said medium comprise the steps of drawing and feeding a liquid of said liquid bath.

15. A system comprising:

a plurality of rollers; and a directing system for guiding, transversely deflecting, and diverting a web of material over said rollers, said directing system including a directing apparatus; and a medium supply device for supplying a medium to said directing apparatus;

wherein said directing apparatus comprises a block which is connected to said medium supply device, said block having a curved surface over which said web is led, said curved surface having a plurality of bores provided in each of separate sections and which extend transversely to said web and through which medium flows out of and against said web from said medium supply device in designated directions at variable velocities and variable volumes, a plurality of said separate sections being provided for said web of material and forming fluid bearings for said web wherein each section is provided with a different pressure thereby forming a pressure gradient to deflect and divert said web from a first guided direction of travel to a second guided direction of travel, depending on the different pressures of the medium in said separate sections.

16. The system as claimed in claim 15, wherein said directing system further comprises lines which extend through said block and which connect said bores to said medium supply device, and control valves, located in said lines outside of said block, for controlling a flow of medium into respective lines.

17. The system as claimed in claim 15, wherein said medium comprises compressed air.

18. The system as claimed in claim 15, further comprising a liquid bath in which said block is disposed, and wherein said medium comprises a liquid of said liquid bath.

19. A directing apparatus for guiding, transversely deflecting, and diverting a web of material which is guided over a number of rollers, said directing apparatus comprising:

a block connected to a medium supply device, said block having a curved surface over which said web is led, said curved surface having a plurality of bores provided in each of separate sections and which extend transversely to said web, a plurality of said separate sections being provided for said web of material and forming fluid bearings for said web wherein each separate section is provided with a different fluid pressure to create a pressure gradient across a width of said web to deflect and divert said web from a first guided direction of travel to a second guided direction of travel, depending on said pressure gradient which urges said web from the surface of the block;

lines which extend through said block and which connect said separate sections to said medium supply device, whereby through said lines said medium flows against said web from said medium supply device; and control valves, located in said lines outside of said block, for controlling a flow of medium into respective lines;

wherein said block is cylindrical in shape and the bores in each separate section are connected to one another and wherein said block has the .separate sections formed in a portion of the curved surface which faces the web, the separate sections having rear sides which are spaced a designated distance from said portion of said curved surface, and wherein said bores include restriction bores which are formed in said sections.

* * * * *